United States Patent [19]

Pike

[11] 3,994,467

[45] Nov. 30, 1976

[54] STILTS FOR USE IN MINE WORKINGS

[75] Inventor: Colin Henry Pike, Wolverhampton, England

[73] Assignee: GKN Sankey Limited, England

[22] Filed: Sept. 22, 1975

[21] Appl. No.: 615,389

[52] U.S. Cl. ..... 248/356; 188/1 C

[51] Int. Cl.[2] ..... E04G 25/00

[58] Field of Search ..... 188/1 C; 248/351, 354 R, 248/354 P, 356; 280/150 SB, 746; 297/386, 216

[56] References Cited

UNITED STATES PATENTS

| | | | |
|---|---|---|---|
| 3,492,888 | 2/1970 | Nishimura et al. | 188/1 C X |
| 3,856,328 | 12/1974 | Koizumi | 188/1 C X |

FOREIGN PATENTS OR APPLICATIONS

| | | | |
|---|---|---|---|
| 198,925 | 7/1938 | Switzerland | 248/354 (P) |
| 323,851 | 1/1930 | United Kingdom | 248/356 |

*Primary Examiner*—Lawrence J. Staab
*Attorney, Agent, or Firm*—Barlow & Barlow

[57] ABSTRACT

A yieldable mining stilt comprises a tube formed with diammetrically opposite, longitudinally extending slots. A bar spans the tube and has its end portions engaged in the slots. The relative dimensions of the end portions of the bar and of the slots are such that movement of the bar along the slots causes deformation of the tube adjacent to the slots. In use, the bar supports the leg of a roof arch. There may be two bars, one above the other, the upper one reversing the deformation caused by the lower one.

8 Claims, 8 Drawing Figures

STILTS FOR USE IN MINE WORKINGS

SUMMARY OF THE INVENTION

The object of the present invention is to provide a stilt which is suitable for supporting a leg of a mine roof support, which will yield under downward loading of the leg to permit controlled descent of the roof support over the working life of the stilt whilst reliably maintaining the required support of the roof at all times and which is relatively inexpensive.

A stilt according to the invention comprises a tube and a deforming member for receiving the downward loading from a leg of a mine roof support which is associated with a stilt in use, the tube being formed with a plurality of longitudinally extending slots, the deforming member having portions which engage in and move along respective ones of said slots and the relative dimensions of the tube and deforming member being such that movement of said portions along respective slots is accompanied by deformation of the tube.

With this construction, the stilt will permit descent of the leg when the downward loading is sufficiently great to deform the tube in such a manner as to permit movement of said portions of the deforming member along the slots. The resistance to downward movement which is provided by the stilt can be varied by varying the initial relative dimensions of the tube and deforming member and the nature of the material of which the tube is formed.

It will be appreciated that the stilt may comprise two components only, namely the tube and the deforming member.

Alternatively, the stilt may include two deforming members, one of which follows the other along the slots and tends to reverse the deformation caused by the other deforming member.

DETAILED DESCRIPTION

Figure 1:
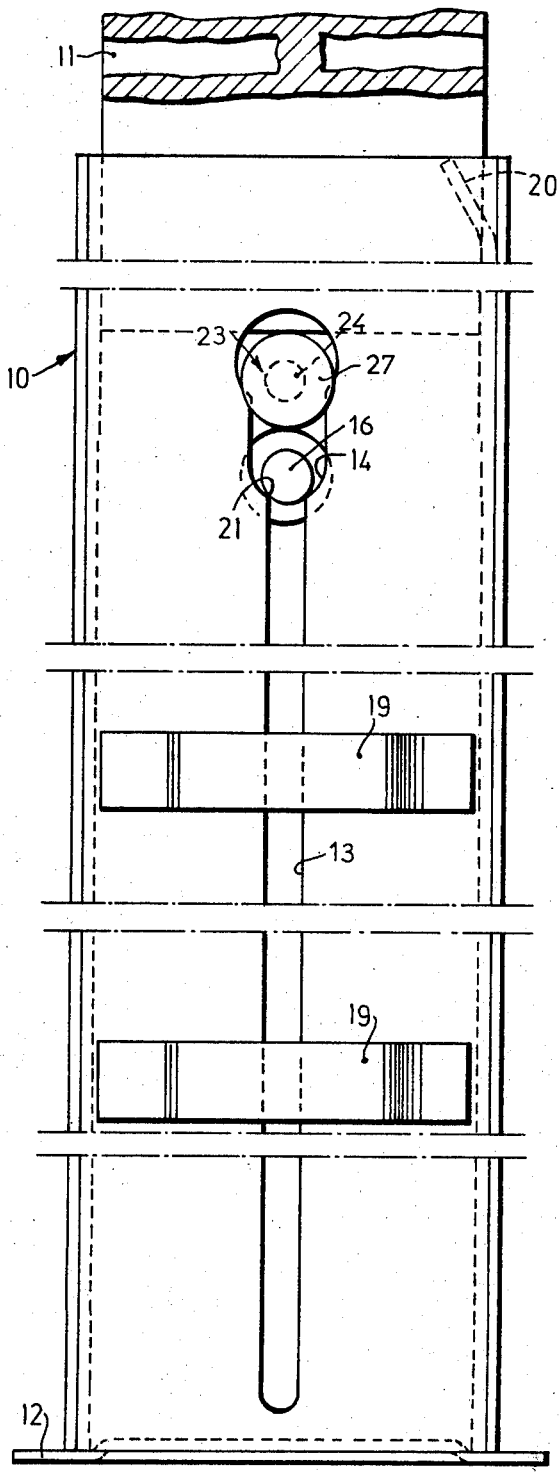
FIG. 1 shows in side elevation one form of stilt in accordance with the invention, together with the lower part of a leg assembled with the stilt.

The stilt illustrated in FIGS. 1 to 5 comprises a tube 10 formed of a metal, for example mild steel, and having a rectangular cross-sectional shape such that an end portion of an H-section leg 11 is a sliding fit within the tube. The leg may be a lower end portion of a mine roof supporting arch or other mine roof support. At the lower end of the tube 10 there is provided a base plate 12 on which the tube stands when in use. The tube may be welded to the base plate.

At diametrically opposite positions, the tube 10 is formed with a pair of slots 13. Each of these slots extends longitudinally of the tube, a lower end of the slot being spaced from the base plate 12 and an upper end of the slot being spaced from an upper end of the tube. In the unused stilt, each of the slots 13 is of uniform width along the major part of its length, a relatively short upper end portion 14 only having a somewhat greater width.

The stilt further comprises a first deforming member in the form of a cylindrical bar 15, opposite end portions 16 of which are received in the wider upper end portions 14 of respective slots 13. A mid-portion 17 of the deforming member extends across the interior of the tube 10. The mid-portion has a diameter somewhat greater than that of the end portions 16 so that the deforming member presents shoulders 18 towards opposite inner faces of the tube 10. The diameter of the end portions is substantially greater than the width of the major part of each of the slots 13 when the stilt is ready for use. The upper end portion of each slot has a width greater than the diameter of the mid-portion 17 so that the deforming member can be inserted lengthwise through the end portion 14 of one of the slots.

The stilt comprises a second deforming member 23 which is of generally-cylindrical form and has two necks 24 situated one adjacent to each end of the deforming member 23. Between the necks 24, lies a mid-portion 25 of the deforming member which presents towards opposite ends of the member annular shoulders 26. At the end of each of the necks 24 opposite to the adjacent shoulder 26 there is a head 27 having the same diameter as the mid-portion 25. The heads 27 present respective shoulders 28 towards the adjacent shoulders 26.

The maximum width of the upper end portion 14 of each slot is slightly greater than the diameter of the mid-portion 25 and heads 27 of the second deforming member so that this deforming member can be inserted lengthwise through the end portion of one of the slots 13. The necks 24 have a diameter slightly less than the width of the major part of the slots 13 prior to deformation of the tube 10 by the end portions 16 of the first deforming member. The separation of each of the shoulders 28 from the adjacent shoulder 26 is equal to the thickness of the walls of the tube 10 prior to deformation thereof by the first deforming member 15.

The tube 10 further comprises a plurality of straps 19, four in the example illustrated, which span respective ones of the slots 13. As shown, opposite end portions of each strap are secured to the tube 10 at positions on opposite sides of the associated slot and a mid-portion of each strap is cranked away from the tube 10 to provide clearance for the adjacent end portion 16 of the first deforming member and for the adjacent head 27 of the second deforming member. A part of each end portion of the strap may be punched into an opening formed in the tube and the end portions of each strap may be welded to the tube. The straps prevent the tube flexing in such a way as to increase the width of the slot 13 without permanent deformation of the metal.

Figure 2:
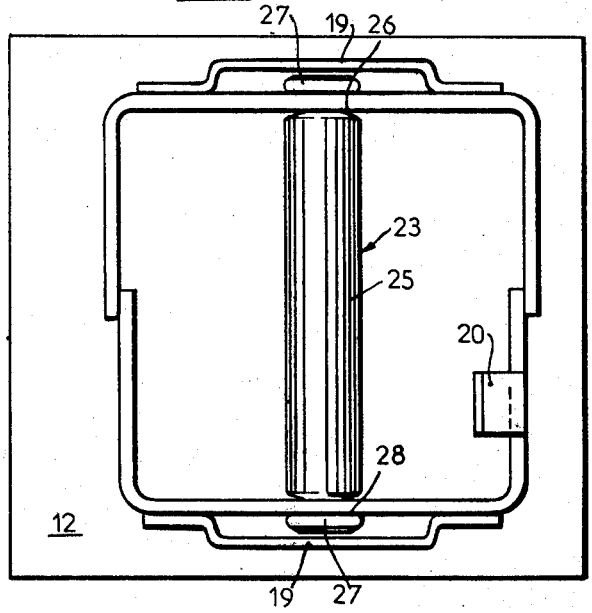
FIG. 2 shows the stilt of FIG. 1 in plan view.
Figure 3:
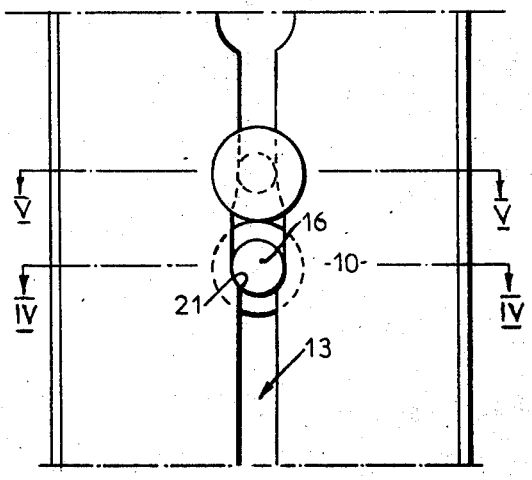
FIG. 3 is a fragmentary view in side elevation of the stilt of FIG. 1 after the leg has descended through a part of the permitted range of movement.
Figure 4:
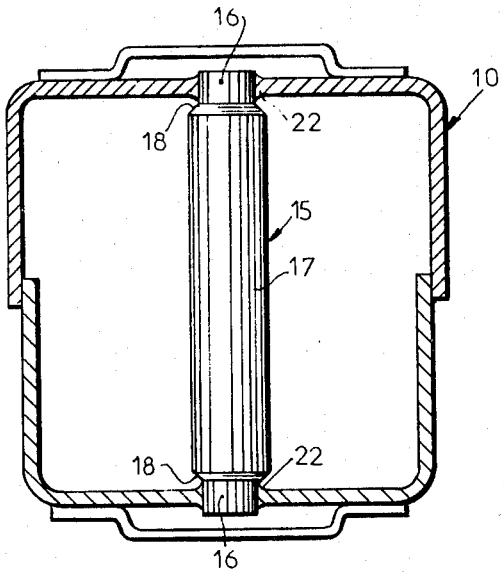
FIG. 4 is a cross section on the line 4—4 of FIG. 3.
Figure 5:
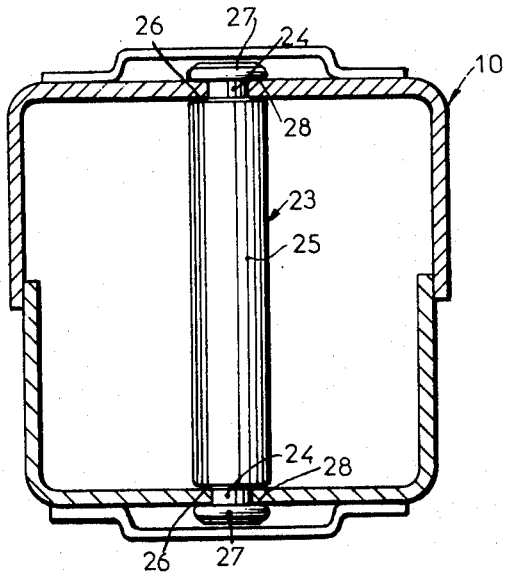
FIG. 5 is a cross section on the line 5—5 of FIG. 4.

As will be seen from FIG. 2, the tube 10 is typically formed of two U-section members, the limbs of which are welded together to form the tube. The slots 13 are cut in the U-section members before the latter are secured together.

Adjacent to the upper end of the tube 10, a tang 20 is bent inwardly from one side wall of the tube to prevent insertion of the leg 11 with the web of the leg extending transversely of the deforming members 15 and 23.

When the stilt is assembled with the leg 11, a lower end portion of the leg is inserted into the upper end of the tube 10 until the end face of the leg engages with the mid-portion 25 of the second deforming member. The mid-portion of this deforming member is also engaged with the mid-portion 17 of the first deforming membr which lies directly beneath the second deforming member. The end portions 16 of the first deforming member engage with the shoulders 21 formed on the tube 10 where the width of each of the slots 13 changes and accordingly the first deforming member supports the second deforming member which in turn supports the leg 11.

If the leg 11 is subjected by the mine roof to a sufficiently large downward loading, the deforming members 15 and 23 will be forced together down the slots 13 thereby deforming the tube 10. This deformation is substantially confined to portions of the tube which border the slots 13. Initially, the deformation will result in a local increase of the width of the slots 13 until this width is sufficient to admit the end portions 16 of the first deforming member, and a consequent thickening of the portions of the tube 10 bordering the slots 13.

As the deforming members 15 and 23 move downwardly, the shoulders 26 and 28 will come into engagement with the thickened portions of the tube 10 so that the second deforming member will be supported both by engagement of its shoulders with the thickened portions of the tube and by the first deforming member. Descent of the leg will continue only if the downward loading is sufficient to cause both the end portions 16 of the first deforming member and the shoulders 26 and 28 of the second deforming member to deform the tube. It will be appreciated that the deformation caused by the shoulders of the second deforming member is a reduction in the thickness of portions of the tube bordering the slots 13 with a consequent reduction in the width of these slots. This deformation may produce the form of the portions of the tube bordering the slots 13 which existed prior to deformation by the first deforming member.

It will be appreciated that once the shoulders 26 and 28 of the second deforming member have engaged with the thickened portions of the tube 10, the resistance to descent of the leg 11 will be substantially constant throughout movement of the deforming members along the slots 13, provided that the width of these slots does not vary. If the resistance to downward movement of the leg is required to vary during such movement, for example to increase, the width of the slots 13 may be varied along their respective lengths accordingly. A gradual reduction in the width of the slots 13 from their upper ends to their lower ends will provide a gradual increase in the resistance to downward movement of the leg as such movement occurs.

If required, the slots 13 may extend to the lower end of the tube 10, the latter being welded to the base plate 12 to prevent laterally outward movement of parts of the tube on opposite sides of the slots 13.

Referring now to the stilt illustrated in FIG. 6, corresponding parts are indicated by like reference numerals with the prefix 1 and the preceding description is deemed to apply thereto accept for the difference hereinafter mentioned.

The slots 113 are slightly tapered over the major parts of their lengths, the slots becoming narrower towards their lower ends. The tube 110 is not provided with transverse straps, as is the tube illustrated in FIGS. 1 to 5, and it will be appreciated that the presence of the slots 13 will permit some degree of laterally outward deflection of parts of the tube 110 on opposite sides of the slots 113 when the stilt is in use, particularly when the deforming members are in a position approximately halfway along the slots 113. Such lateral deflection would tend to increase the width of the slots 113 without permanent deformation of the tube 110. The shape of the slots 113 is selected to compensate for such lateral deflection and to provide an approximately constant resistance to downward movement of the deforming members 115 and 123 over the first half of the permitted range of movement. In consequence of the tapered shape of the slots 113, the resistance to downward movement of the deforming members increases gradually over the second half of the permitted range of movement.

If an approximately constant resistance to downward movement of the deforming members 115 and 123 is required over the entire permitted range of movement, each of the slots 113 would be shaped to taper slightly from both its upper and lower ends towards a mid-portion of the slot where the width is a minimum. This variation in width of the slot would compensate for lateral deflection of the tube 110 and provide an approximately constant resistance to descent of a leg with which the stilt is used.

The tube 110 is conveniently formed by joining two channel-section members with the free ends of their respective limbs in abutting relation, the joints coinciding with the centre lines of the slots 113. Prior to joining of the channel-section members together, the free ends of their respective limbs would be formed with respective recesses corresponding to one half of a slot 113. Such recesses may be formed by milling or stamping.

Adjacent to the upper end of the tube 110, two flaps 130 and 131 are bent inwardly from those walls of the tube which lie between the walls in which the slots 113 are formed. The free edges of the flaps 130 and 131 are separated by a gap of sufficient width to accommodate the web of an H-section leg which is to be assembled with the stilt. The flaps may be inclined to the base plate 112 at an angle in the region of 10° or 20° and are of such a size that, in combination with an H-section leg which extends in the tube 110, they substantially close the upper end of the tube against ingress of pieces of rock or other debris which might otherwise interfere with proper operation of the stilt. The flaps 130 and 131 are not intended to exclude dust from the tube 110 and there is a significant clearance between the flaps and an H-section leg when the latter is assembled with the stilt.

Figure 6:
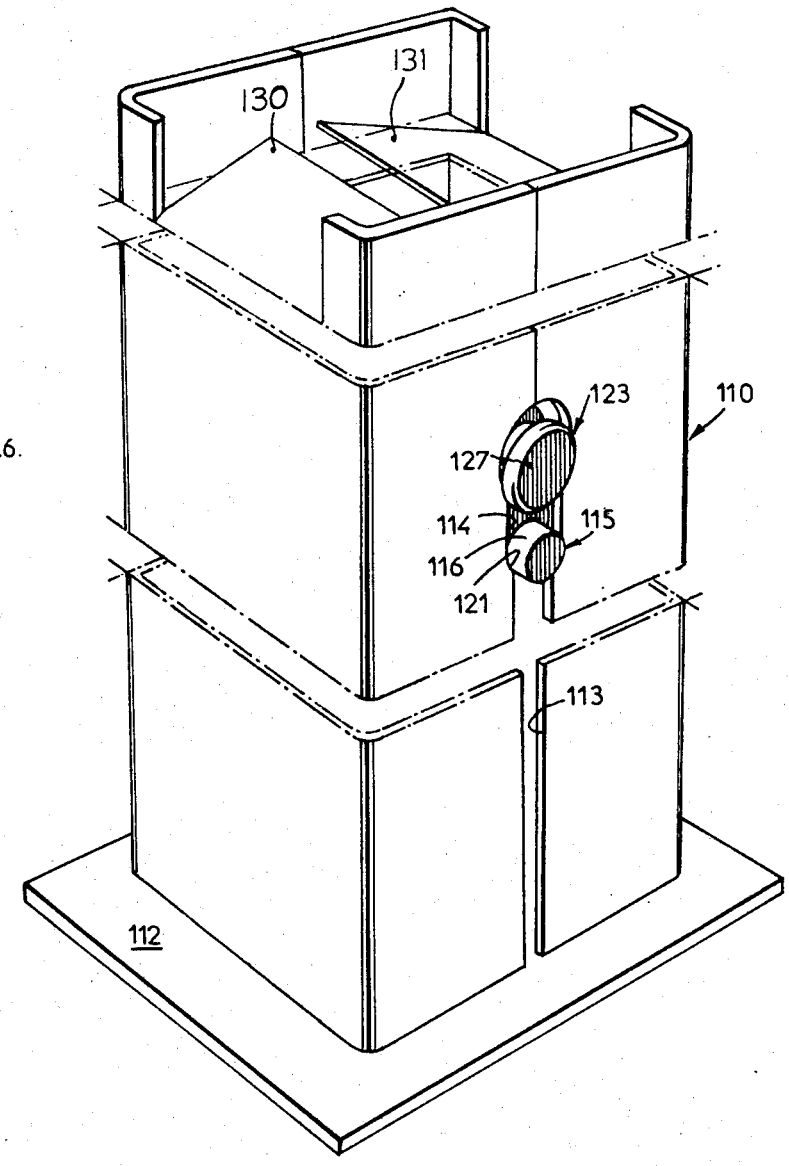
FIG. 6 is a perspective view of a further stilt embodying the invention.

Flaps similar to the flaps 130 and 131 shown in FIG. 6 may be provided in the stilt illustrated in FIGS. 1 to 5 in place of the tange 20.

Figure 7:
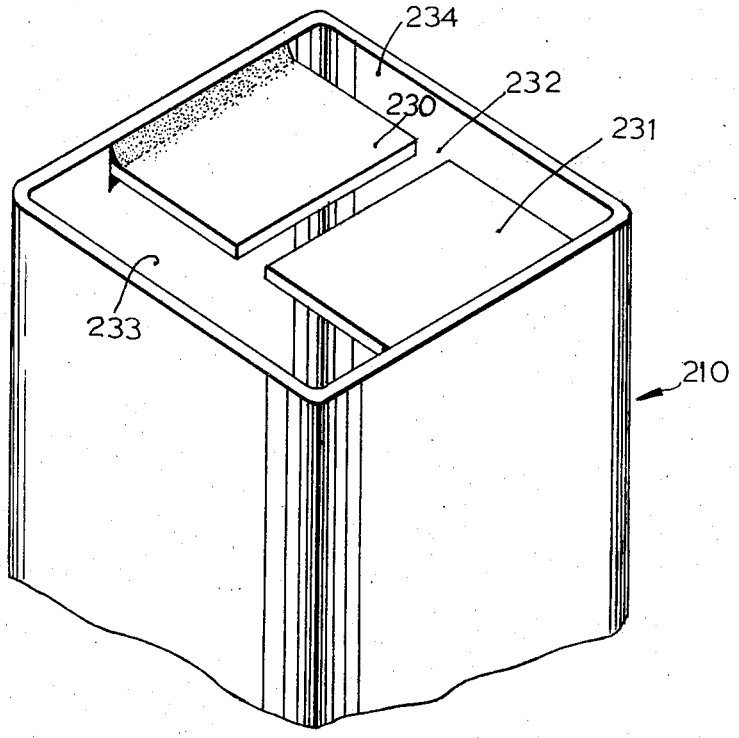
FIG. 7 is a perspective view of an upper end portion only of a yet further stilt embodying the invention and FIG. 8 is a fragmentary perspective view illustrating a yet further form of stilt in accordance with the invention, together with a lower part of a leg assembled with the stilt.

In FIG. 7 there is illustrated an alternative arrangement of closure elements which may be applied either to the stilt of FIGS. 1 to 5 or the stilt of FIG. 6.

In FIG. 7, only an upper end portion of the tube 210 is shown. It will be appreciated that the lower portion of the tube which is not illustrated is formed with longitudinally extending slots in which there are engaged deforming members corresponding to the deforming members 15 and 23 illustrated in FIGS. 1 to 5. The tube 210 is of rectangular shape in cross section and these slots are formed in two opposite sides. There projects from each of the other pair of opposite sides at positions adjacent to the upper end of the tube 10 respective plates 230 and 231. These plates are welded to the sides of the tube 210. Each of the plates is rectangular.

There is between the plates 230 and 231 a gap 232 of sufficient width to receive the web of an H-section leg which is to be assembled with the stilt. Between the slotted sides of the tube 210 and the plates 230 and 231 there are respective gaps 233 and 234 of sufficient width to accommodate the flanges of the H-section leg. When the leg is assembled with the stilt, the plates 230 and 231 substantially close the upper end of the tube 210 against entry of pieces of rock which may interfere with proper operation of the stilt.

Figure 8:
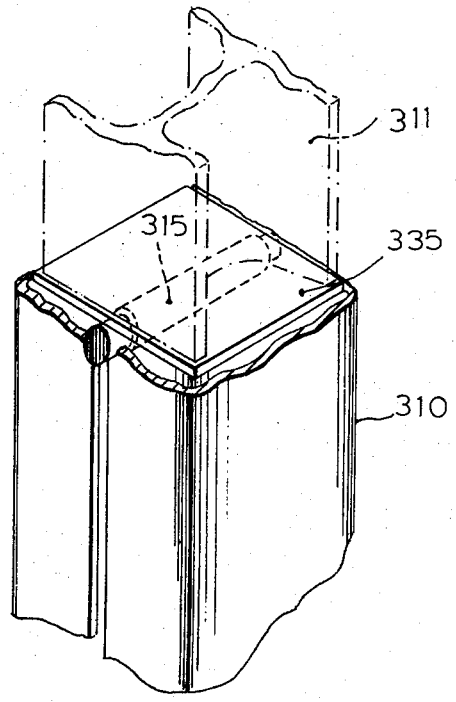

A further alternative arrangement for excluding from the stilt of FIGS. 1 to 5 and from the stilt of FIG. 6 debris which may interfere with proper operation of the stilt is illustrated in FIG. 8. In this Figure there is shown a mid-portion only of the tube (indicated by the reference number 310) one of the deforming members (indicated by the reference number 315) a lower end portion of an associated leg (indicated by the reference number 311) and a closure plate 335.

The closure plate 335 has a shape and size corresponding to the cross sectional dimensions of the tube 310, so that the plate fits with a small clearance within the tube. The plate is secured to the upper side of the deforming member 315, for example by welding. The leg 311 of the roof support rests on the upwardly presented face of the plate 335, the plate being interposed between the leg and the deforming member.

The plate 335 does not prevent debris entering the tube 310, but it does prevent debris obstructing descent of the leg 311, since it prevents debris entering that part of the tube which lies below the lower end of the leg.

It will be noted that during use of either of the stilts illustrated in the accompanying drawings, descent of the leg causes deformation of a part of the tube 10 or 110 which, up to that point in time, has not been deformed by the deforming members. Since the resistance to deformation of the tube provides substantially the entire resistance to descent of the leg, this resistance can be predetermined throughout the entire range of movement of the leg permitted by the stilt by forming the slots to an appropriate shape.

Whilst we prefer to employ deforming members in the form of bars and a tube of square or rectangular cross-section with slots at diametrically opposite positions, it would be within the scope of the invention to provide deforming members having three or more arms whereof respective end portions engage in a corresponding number of slots formed in the tube.

Both the stilt illustrated in FIGS. 1 to 5 and the stilt illustrated in FIG. 6 of the accompanying drawings could be modified by the omission of the second deforming member. In this case, the end of the leg of the roof support would engage with the mid-portion of the first deforming member and the deformation caused by descent of the leg would be a widening of the slots.

We prefer to employ two deforming members simultaneously, as illustrated in the accompanying drawings, since this enables approximately twice the resistance to downward loading to be obtained without increasing the thickness of the material used to form the tube.

It would also be within the scope of the invention to modify the stilts illustrated in the accompanying drawings by omitting the first deforming member and, during manufacture of the stilt, deforming the material of which the tue is formed to provide thickened portions bordering the slots.

The upper end portion 114 of the tube 110 shown in FIG. 6 may have dimensions such that the first deforming member 115 and the second deforming member 123 can be inserted one after the other lengthwise through the end portion 114 of one of the slots 113 and so placed in their respective operative positions with respect to the tube 110 after the latter has been formed. Alternatively, the dimensions of the end portions 114 may be somewhat smaller so that they can receive the necks 124 and end portions 116, but such that the heads 127 and mid-portions 117 and 125 cannot pass through the end portions of the slots. In this latter case, the deforming members would be placed in their operative positions with respect to the tube 110 during assembly of the two halves of the tube with one another so that when the halves of the tube have been welded together the deforming members are made captive and cannot subsequently be separated from the tube.

I claim:

1. A stilt for association with a leg of a mine roof support, the stilt comprising a tube and a deforming member for receiving a downward load from the leg, the tube being preformed with a plurality of longitudinally-extending slots, the deforming member having portions which engage in and move along respective ones of the slots, each of said portions being a neck lying between two shoulders of the deforming member, the width of the slot being greater than the corresponding dimension of the neck and the thickness of the portions of the tube bordering each of said slots, over the major part of the length of the slot, being, prior to movement of said portions of the deforming member along the slots, greater than the separation of said shoulders, whereby the tube is deformed to decrease the width of the slot when the neck of the deforming member is forced along the slot.

2. A stilt for association with a leg of a mine roof support, the stilt comprising a tube and two deforming members, the tube being pre-formed with a plurality of longitudinally extending slots, each deforming member having respective portions which engage in and move along the slots, the relative dimensions of the tube and deforming members being such that movement of said portions along the slots is accompanied by deformation of the tube, one of the deforming members receiving a downward load from the leg and said one deforming member following the other along said slots and tending to reverse the deformation caused by said other deforming member.

3. A stilt for association with a leg of a mine roof support, the stilt comprising a tube, a first deforming member and a second deforming member for receiving a downward load from the leg, the tube being preformed with a plurality of longitudinally-extending slots, each deforming member having respective portions which engage in and move along the slots, the width of each of said slots, over the major part of the length of the slots, being, prior to movement of said portions of the deforming members along the slots, less than the corresponding dimension of that portion of the first deforming member which is received in the slot and the second deforming member having neck portions which are received in respective ones of said slots and, at opposite ends of each neck portion, a pair of shoulders which face each other, the width of said neck portion being less than the width of the corresponding portions of said first deforming member which are received in the slots and the spacing between said shoulders being approximately equal to the thickness of portions of the tube bordering the slots prior to movement of the first deforming member along the slots, whereby the tube is deformed by the first member to increase the width of each slot when said portion of the first deforming member is forced along the slot and the deformation caused by the first deforming member is at least parly reversed by the second deforming member when the latter is forced along the slot.

4. A stilt according to claim 2 wherein the width of each slot is a minimum at a mid-portion of the slot.

5. A stilt according to claim 2 including a plurality of straps, each strap spanning one of said slots and being secured to the tube on opposite sides of the slot.

6. A stilt according to claim 2 further comprising closure elements which project inwardly of the tube from opposite side walls thereof at respective positions adjacent to an upper end of the tube.

7. A stilt according to claim 2 further comprising a closure element attached to one of the deforming members, the closure element having dimensions corresponding to the internal dimensions of the tube whereby the closure element prevents rubble passing through the tube from an upper end thereof to a lower end thereof.

8. A stilt according to claim 3 wherein said first deforming member has a mid-portion which is disposed within the tube and shoulders at opposite ends of the mid-portion, the mid-portion having cross-sectional dimensions which exceed those of the portions of the first deforming member which are received in the slots and said shoulders abutting inner faces of the tube adjacent to the slots.

* * * * *